US006102782A

United States Patent [19]

Custer et al.

[11] Patent Number: 6,102,782

[45] Date of Patent: Aug. 15, 2000

[54] SYSTEM AND APPARATUS FOR DISTRIBUTING FLUSH FLUID TO PROCESSING EQUIPMENT

[75] Inventors: Daniel G. Custer, Caldwell; Scott E. Moore, Meridian, both of Id.

[73] Assignee: Micron Technology, Inc., Boise, Id.

[21] Appl. No.: 09/055,348

[22] Filed: Apr. 6, 1998

[51] Int. Cl.[7] ..... B24B 7/00

[52] U.S. Cl. ..... 451/67; 451/36; 451/99; 451/446

[58] Field of Search ..... 451/36, 60, 65, 451/67, 99, 446, 447

[56] References Cited

U.S. PATENT DOCUMENTS

| | | | |
|---|---|---|---|
| 2,994,314 | 8/1961 | Wayland et al. | 451/446 X |
| 3,392,493 | 7/1968 | Hofmann et al. | 451/446 X |
| 3,411,248 | 11/1968 | Dwyer et al. | 451/446 X |
| 3,887,457 | 6/1975 | Marston et al. . | |
| 4,059,929 | 11/1977 | Bishop | 451/60 |
| 4,086,029 | 4/1978 | Crane et al. . | |
| 4,087,358 | 5/1978 | Oder . | |
| 4,680,893 | 7/1987 | Cronkhite et al. . | |
| 4,872,356 | 10/1989 | Barnett et al. . | |
| 5,261,776 | 11/1993 | Burck et al. . | |
| 5,314,843 | 5/1994 | Yu et al. . | |
| 5,486,129 | 1/1996 | Sandhu et al. . | |
| 5,514,245 | 5/1996 | Doan et al. . | |
| 5,643,060 | 7/1997 | Sandhu et al. . | |
| 5,645,682 | 7/1997 | Skrovan . | |
| 5,658,183 | 8/1997 | Sandhu et al. . | |
| 5,664,990 | 9/1997 | Adams et al. . | |
| 5,679,065 | 10/1997 | Henderson . | |
| 5,679,169 | 10/1997 | Gonzales et al. . | |
| 5,885,134 | 3/1999 | Shibata et al. | 451/60 |
| 5,895,315 | 4/1999 | Pinder, Jr. | 451/60 |

*Primary Examiner*—Timothy V. Eley
*Attorney, Agent, or Firm*—Dickstein Shapiro Morin & Oshinsky LLP

[57] ABSTRACT

An apparatus is provided with a wafer polishing tool, a source of slurry, and a source of low pressure de-ionized water. The slurry is supplied to the tool for chemical-mechanical planarization. Periodically, the slurry source is shut off and the de-ionized water is used to flush the apparatus. The desired safe low pressure of the de-ionized water may be maintained by opposed one-way check valves. The flushing system prevents the slurry from clogging or becoming stagnant, and prevents valves and pumps within the apparatus from malfunctioning. Moreover, the low pressure de-ionized water will not contaminate the higher pressure slurry even in the event of a system malfunction.

16 Claims, 3 Drawing Sheets

SYSTEM AND APPARATUS FOR DISTRIBUTING FLUSH FLUID TO PROCESSING EQUIPMENT

BACKGROUND OF THE INVENTION

The present invention relates generally to a system for supplying a flush fluid to a semiconductor polishing machine or other apparatus. More particularly, the invention relates to a system for flowing de-ionized (DI) water through an apparatus to prevent slurry from clogging the apparatus and/or to prevent malfunctioning of valves or pumps. The present invention also relates to a control system for operating a flush system.

In the course of manufacturing integrated circuits, it is typically desirable to selectively polish or planarize the surfaces of semiconductor wafers. Such mechanical treatment may be done to remove high topography, surface defects, scratches, roughness, or embedded particles. A chemical slurry may be used during such polishing to facilitate high removal rates and film selectivity. Polishing with slurry is sometimes called chemical-mechanical planarization (CMP).

Known CMP systems are illustrated in U.S. Pat. Nos. 5,679,169 (Gonzales et al.), 5,679,065 (Henderson), 5,658,183 (Sandhu et al.), 5,645,682 (Skrovan), 5,643,060 (Sandhu et al.), 5,514,245 (Doan et al.), and 5,314,843 (Yu et al.).

Slurries for use in CMP tools may contain small, abrasive particles and/or reactive chemicals. Conventional CMP slurries contain solutions of alumina or silica. Other slurries for integrated circuit (IC) manufacturing processes are mentioned in U.S. Pat. No. 5,664,990 (Adams et al.). Slurries tend to dry out, especially when they become stagnant or are exposed to air. Slurries may clog the conduits in polishing machinery and other manufacturing apparatuses. In addition, slurries can cause valves and pumps to stick or malfunction.

SUMMARY OF THE INVENTION

The present invention relates to a system for conveniently and reliably flushing slurry equipment with DI water (or another suitable flush fluid). In one aspect of the invention, a one-way check valve is used to supply the DI water to the slurry equipment at a controlled pressure.

In another aspect of the invention, a second check valve is used as a pressure regulator to control the pressure of the DI water upstream from the first check valve. In a preferred embodiment of the invention, the second check valve operates by draining relatively high pressure DI water away from the first check valve.

In another aspect of the invention, one-way valves are employed to provide a precisely controlled source of low pressure DI water.

The present invention also relates to a system that supplies slurry to a CMP tool at a pressure greater than the pressure of the flush liquid. This way, the flush liquid does not enter the slurry distribution conduits even when the valves in the system malfunction.

The present invention provides an uncomplicated, dependable and economical system for supplying flush liquid to clean an apparatus that uses slurry. In a preferred embodiment of the invention, the system employs spring-loaded one-way valves to control the pressure and flow direction of the flush liquid. In another aspect of the invention, a four-port valve apparatus (with two inlets and two outlets) is employed to control the flow of slurry.

The present invention may be adapted for use with a Strasbaugh 6DS-SP wafer polishing system. However, the invention should not be limited to any particular machinery. The invention is applicable to a variety of wafer handling systems. In addition, the invention may be used to flush materials other than slurry. For example, the invention may be used to flush caustic soda from a fluid handling apparatus. In addition, the invention may use dry air or nitrogen as a flush fluid. The invention is not limited to use with CMP or other slurry handling equipment.

In a preferred embodiment of the invention, a programmable system provides automatic and manual flush sequence control. The operation of the system may be programmed for predetermined delays and periodic timed flush cycles.

An advantage of the invention is that it can prevent contamination of slurry by DI water even in the event of a system malfunction. Another advantage is that the invention may be used to prevent slurry from flowing into the source of the DI water.

Another advantage of the invention is that it avoids the need for a conventional high purity pressure regulator. Such conventional high purity pressure regulators are generally expensive and tend to not regulate well. Thus, the invention may be employed at relatively low cost and in an uncomplicated manner.

These and other features and advantages of the invention will become apparent from the following detailed description of preferred embodiments of the present invention.

DETAILED DESCRIPTION OF PREFERRED EMBODIMENTS

Figure 1:
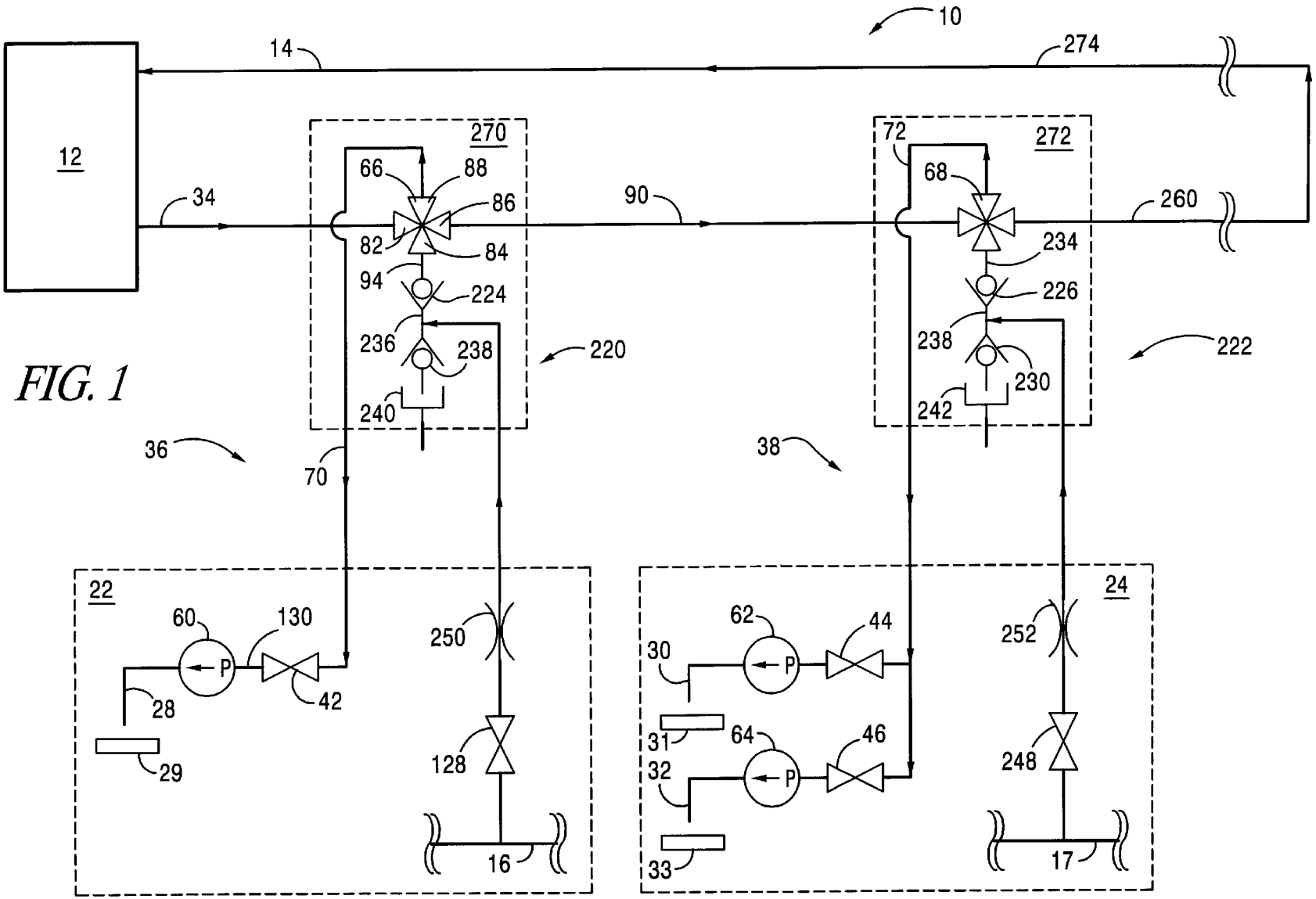
FIG. 1 is a partial schematic view of a portion of an integrated circuit manufacturing system constructed in accordance with the present invention.

Referring now to the drawings, where like reference numerals designate like elements, there is shown in FIG. 1 a system 10 for use in the production of integrated circuit products or semiconductor preforms. The system 10 has a slurry source 12, at least one slurry distribution loop 14, and flush liquid sources 16, 17. The distribution loop 14 is connected to one or more CMP tools such as polishing equipment or other wafer handling devices 22, 24. Each tool 22, 24 has at least one nozzle 28, 30, 32 for dispensing slurry onto a platen 29, 31, 33.

By way of example, the pressure in the distribution loop 14 may be about ten to fifteen pounds per square inch (psi). The pressure in the distribution loop 14 may be maintained by appropriate pumps and/or pressure regulators (not shown).

The distribution loop 14 is connected to the tools 22, 24 by respective slurry supply systems 36, 38. Each supply system 36, 38 has at least one isolation valve 42, 44, 46 for selectively preventing fluid flow. In addition, the flow of liquid through the supply systems 36, 38 toward the tools 22, 24 may be positively controlled by appropriate peristaltic pumps 60, 62, 64.

Although slurry supply systems 36, 38 are shown connected to two polishers 22, 24 in the illustrated embodiment, the invention may be practiced with more or less supply systems and tools. If desired, the invention may be practiced with just one slurry supply system and one CMP tool.

Each slurry supply system 36, 38 is connected to the distribution loop 14 by a respective four-port distribution and flush valve apparatus 66, 68. In the illustrated embodiment, the first supply system 36 is connected to a first four-port valve apparatus 66 by a connector conduit 70. The second supply system 38 is connected to the second four-port valve apparatus 68 by another conduit 72. The invention is not limited, however, to the particular manner in which the supply systems 36, 38 are shown in the drawings matched up to the four-port valve apparatuses 66, 68.

Figure 2:
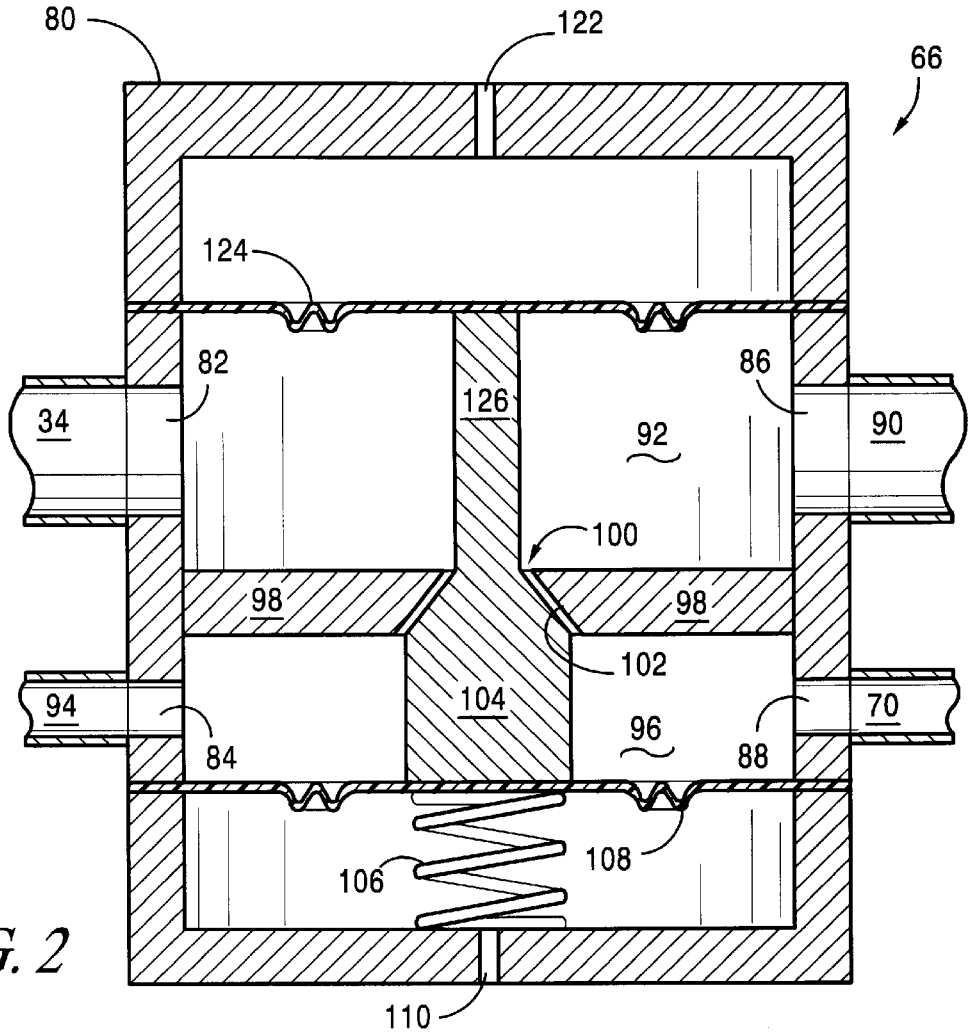
FIG. 2 is a cross sectional view of a four-port distribution and flush valve apparatus for the system of FIG. 1.

Referring now to FIG. 2, each four-port valve apparatus 66, 68 has a main housing 80, first and second inlet ports 82, 84, and first and second outlet ports 86, 88. The first inlet port 82 is connected to a slurry supply conduit 34. The first outlet port 86 is connected in the downstream direction to a connector conduit 90. The valve chamber 92 between the first inlet and outlet ports 82, 86 is open at all times to provide an essentially unrestricted flow passage through the valve apparatus 66.

The second inlet port 84 is connected to the DI water line 16 by a conduit 94. The second outlet port 88 leads downstream to the connector conduit 70. The valve chamber 96 between the second inlet and outlet ports 84, 88 provides an unrestricted flow passage from the second inlet port 84 to the second outlet port 88.

The first and second valve chambers 92, 96 are separated by a wall 98. An opening 100 is provided in the center of the wall 98 to provide fluid communication from the first valve chamber 92 to the second valve chamber 96. The opening 100 has a conical poppet valve seat 102 which is selectively closed by a valve stem 104. The valve stem 104 is biased toward the closed configuration (with the valve stem 104 in contact with the valve seat 102) by a compression spring 106. The compression spring 106 is isolated from the fluid in the second chamber 96 by a flexible diaphragm seal 108. A vent 110 is provided for venting air on the spring side of the diaphragm seal 108.

The valve stem 104 is actuated by a pneumatic system which includes a source 122 of pneumatic control pressure, an actuator diaphragm 124, and an axially reciprocable actuator stem 126 fixed to the actuator diaphragm 124. In operation, the actuator stem 126 is biased toward the valve stem 104 in response to pressure from the pneumatic source 122 to move the valve apparatus 66 to its open slurry supply configuration.

In the open configuration, slurry flows into the valve apparatus 66 through the first inlet port 82 and flows out of the valve apparatus 66 through both the first and second outlet ports 86, 88 (provided the shut-off valve 42 is open and the pump 60 is operating).

When the valve apparatus 66 is in its closed configuration (when the valve stem 104 is seated in the opening 100), slurry continues to flow through the first outlet port 86. Slurry is prevented, however, from flowing into the second valve chamber 96. In the closed configuration, DI water may flow from the second inlet port 84 to the second outlet port 88, provided the DI water flush valve 128 is open, as discussed in more detail below.

The present invention should not be limited to the specific valve apparatus 66 shown in the drawings. The invention may be performed, for example, with an electromagnetically actuated valve apparatus.

The DI water from the source 16 may be used to flush the slurry supply system 36. Thus, the DI water may be used to prevent slurry from becoming stagnant or clogging the conduits 70, 130 that form part of the slurry supply system 36 and to ensure reliable non-sticking operation of the valve 42 and pump 60. The DI water may also be used to flush or refresh certain components of the polisher 22.

Referring now to FIG. 1, the flush liquid sources 16, 17 are connected to the four-port valve apparatuses 66, 68 by respective pressure regulating systems 220, 222. The pressure regulating systems 220, 222 have opposed first and second spring-loaded check valves 224, 226, 228, 230. Each check valve 224–230 permits flow in only one direction. The first check valves 224, 226 allow DI water to flow through downstream conduits 94, 234 to the four-port valve apparatuses 66, 68.

In the illustrated embodiment, the pressure of the DI water in the conduits 236, 238 upstream from the first check valves 224, 226 is maintained at a pressure of about seven psi. This upstream pressure may be maintained by constructing the second one-way valves 228, 230 such that they are opened automatically at pressures greater than seven psi. DI water that flows through the second check valves 228, 230 may enter drains 240, 242. If desired, the drains 240, 242 may be connected to the DI water lines 16, 17 via suitable recirculation conduits (not illustrated). The DI water sources 16, 17 may be connected to the pressure regulating systems 220, 222 by appropriate shut-off valves 128, 248.

The pressure of the DI water in the lines 16, 17 may be maintained by an appropriate pump or pressure regulating device (not illustrated). For example, the pressure in the lines 16, 17 may be maintained at about forty to sixty psi. Suitable flow restrictions 250, 252, which may be formed of selected tubing sizes and lengths, may be provided downstream from the shut-off valves 128, 248 to reduce the pressure of the DI water as it flows from the lines 16, 17 and through the pressure regulating systems 220, 222. The flow restrictions 250, 252 prevent excessive drainage through the second one-way check valves 228, 230.

The pressure drop across the first check valves 224, 226 may be about one to two psi. Consequently, by maintaining the fluid pressure at seven psi in the upstream conduits 236, 238, the fluid pressure within the downstream conduits 94, 234 leading to the four-port valve apparatuses 66, 68 may be reliably maintained at about five to six psi. In the illustrated embodiment, the second one-way valves 228, 230 are used as pressure regulators to maintain the pressure in the upstream conduits 236, 238 at the desired pressure (in the illustrated embodiment, at seven psi).

In a preferred embodiment of the invention, the closing force of the springs in the second check valves 228, 230 may be adjustable to adjust the pressure in the upstream conduits 236, 238, and to thereby indirectly adjust the pressure in the downstream conduits 94, 234. During a flushing operation, the pressure in the downstream conduits 94, 234 will be equal to the pressure in the upstream conduits 236, 238 minus the pressure drop across the first one-way valves 224, 226.

An advantageous feature of the illustrated embodiment is that the pressure of the DI water supplied to the four-port valve apparatuses 66, 68 is less than the slurry pressure prevailing in the distribution loop 14, 34, 90, 260. The pressure of the slurry in the distribution loop 14, 34, 90, 260 is higher than the pressure of the DI water passing through the first one-way valves 224, 226. This way, if the four-port valve apparatuses 66, 68 become stuck or fail, DI water will not contaminate the slurry in the distribution loop 14, 34, 90, 260. The pressure prevailing in the distribution loop 14, 34, 90, 260 will prevent the relatively low pressure DI water from flowing into the distribution loop 14, 34, 90, 260.

Another advantage of the invention is that if one of the four-port valve apparatuses 66, 68 fails or does not close properly, the first check valves 224, 226 prevent the slurry from entering the main portions 236, 238 of the flush liquid supply apparatuses 220–230. Slurry will not back up through the one-way valves 224, 226, even though the pressure of the slurry is greater than the pressure in the upstream conduits 236, 238. Slurry will not back up through the one-way valves 224, 226 even in the event the DI water shut-off valves 128, 248 fail or become stuck closed.

In a preferred embodiment of the invention, the four-port valve apparatuses 66, 68 and the first and second check valves 224–230 are contained within respective distribution boxes 270, 272. The distribution boxes 270, 272 provide chemical containment in the event of valve leakage or malfunction.

In a preferred embodiment of the invention, the slurry source 12 is provided with a bulk slurry container (not illustrated). The bulk slurry is transferred to a mixing chamber (not illustrated). One or more additives may be supplied to the slurry in the mixing chamber. The bulk slurry and the additives are mixed together in the mixing chamber by a suitable mixing device (not shown).

The mixed slurry (treated with the additives) is then flowed through the slurry distribution loop 14. Unused slurry may be recycled to the source 12 via recirculation conduits 260, 274. Although only one distribution loop is shown in the drawings, the invention may be practiced with two or more distribution loops connected to the slurry source 12.

Figure 3:
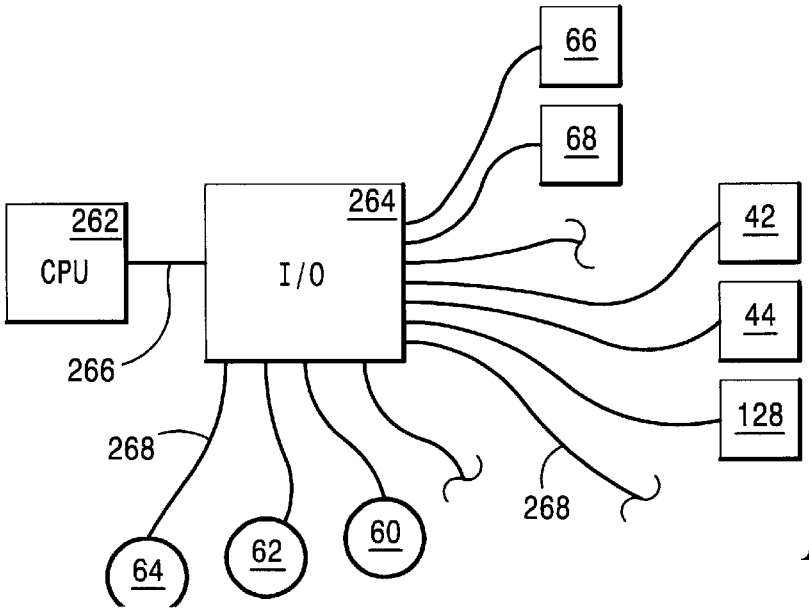
FIG. 3 is a schematic view of a programmable control system for the manufacturing system of FIG. 1.

FIG. 3 schematically illustrates a control system for operating the pumps 60–64 and valves 42–46, 66, 68, 128, 248 discussed above. The control system has a central processing unit (CPU) 262 and an input/output (I/O) unit 264. The CPU 262 may be, for example, a programmable general purpose computer. The illustrated I/O unit 264 may be a suitable keyboard and monitor operatively connected (266) to the CPU 262. The various pumps 60–64 and valves 42–46, 66, 68, 128, 248 are controlled and monitored via appropriate signal lines (collectively designated by reference numeral 268).

The CPU 262 may be programmed to control the pumps 60–64 and valves 42–46, 66, 68, 128, 248 both automatically and manually. The valves 42–46, 66, 68, 128, 248 may be pneumatically or electro-magnetically actuated.

Referring now to the timing chart of FIG. 4, where time proceeds from left to right, the manner by which the first slurry supply system 36 is controlled by the control system 262, 264 may be as follows:

Starting at time=t1, the system 10 is in a normal operation mode and the polisher 22 is in a ready state. Thus, at time=t1, the first four-port valve apparatus 66 is in its open slurry supply configuration, the isolation valve 42 is closed, the first check valve 224 is closed, the pump 60 is off, and the first DI flush valve 128 is closed. In this state, slurry is not supplied to the platen 22.

At time=t2, the system 10 is still in a normal operation mode, but the tool 22 is in a polishing state. Thus, at time=t2, the valve apparatus 66 is in its open slurry supply configuration, the isolation valve 42 is open, the first check valve 224 is closed, the pump 60 is on, and the DI flush valve 128 is closed. In this condition, slurry is supplied to the platen 29.

At time=t3, which is the start of the flush cycle, a delay is provided to ensure that the four-port valve apparatus 66 is closed before the flush supply is turned on. Thus, at time=t3, the four-port valve apparatus 66 is closed (the valve stem 104 is seated in the opening 100), the tool isolation valve 42 is closed, the check valve 224 remains closed, the pump 60 is turned off, and the flush valve 128 is closed.

The CPU 262 may be programmed to reach time=t3 (initiate flush cycle) automatically after the polisher 22 operates with slurry for a predetermined amount of time. Thus, for example, the CPU 262 may be programmed to discontinue the flow of slurry to the tool 22 and to start a DI water flush sequence, every ten minutes. In addition, a signal may be inputted manually by the operator through the I/O unit 264 to jump to time=t3 (to start a flush sequence) at any time.

At time=t4, the four-port valve apparatus 66 remains in its closed configuration, the isolation valve 42 is opened, the pump 60 is turned on to scavenge liquid through the slurry supply system 36, and the flush valve 128 is opened. The check valve 224 opens automatically and DI water flows through the slurry supply system 36 and through the nozzle 28.

The elapsed time from time=t3 to time=t4 may be set by the operator through the I/O unit 264. For example, the CPU 262 may be set to switch the flush valve 128 to its open condition (time=t4) two seconds after the program reaches time=t3. Longer or shorter delays may be programmed into the CPU 262 if desired.

At time=t5, the flush cycle is concluded. The duration of the flushing operation that occurs from time=t4 to time=t5 may be programmed in the CPU 262 to be, for example, one-hundred to one-hundred-eighty seconds. The operator may stop the flushing cycle at any time by manually causing the program to jump to time=t5. At time=t5, the isolation valve 42 is closed, the pump 60 is turned off, the flush valve 128 is closed, and the check valve 224 closes automatically. At time=t5, the tool 22 is taken off line.

After a desired delay from time=t5 to time=t6, a slurry prime cycle is initiated. The four-port valve apparatus 66 and the flush valve 128 remain closed while the isolation valve 42 is opened and the pump 60 is turned on. At this stage of the slurry prime cycle, the excess DI water is pumped out of the slurry supply system 36. The conduit 70 is left at a negative pressure, such that no excess DI water flows into the distribution loop 14.

Subsequently, at time=t7, priming occurs by opening the four-port valve apparatus 66. When the system 10 is adequately primed, it resumes the condition it was in at time=t2 (tool polishing).

Figure 4:
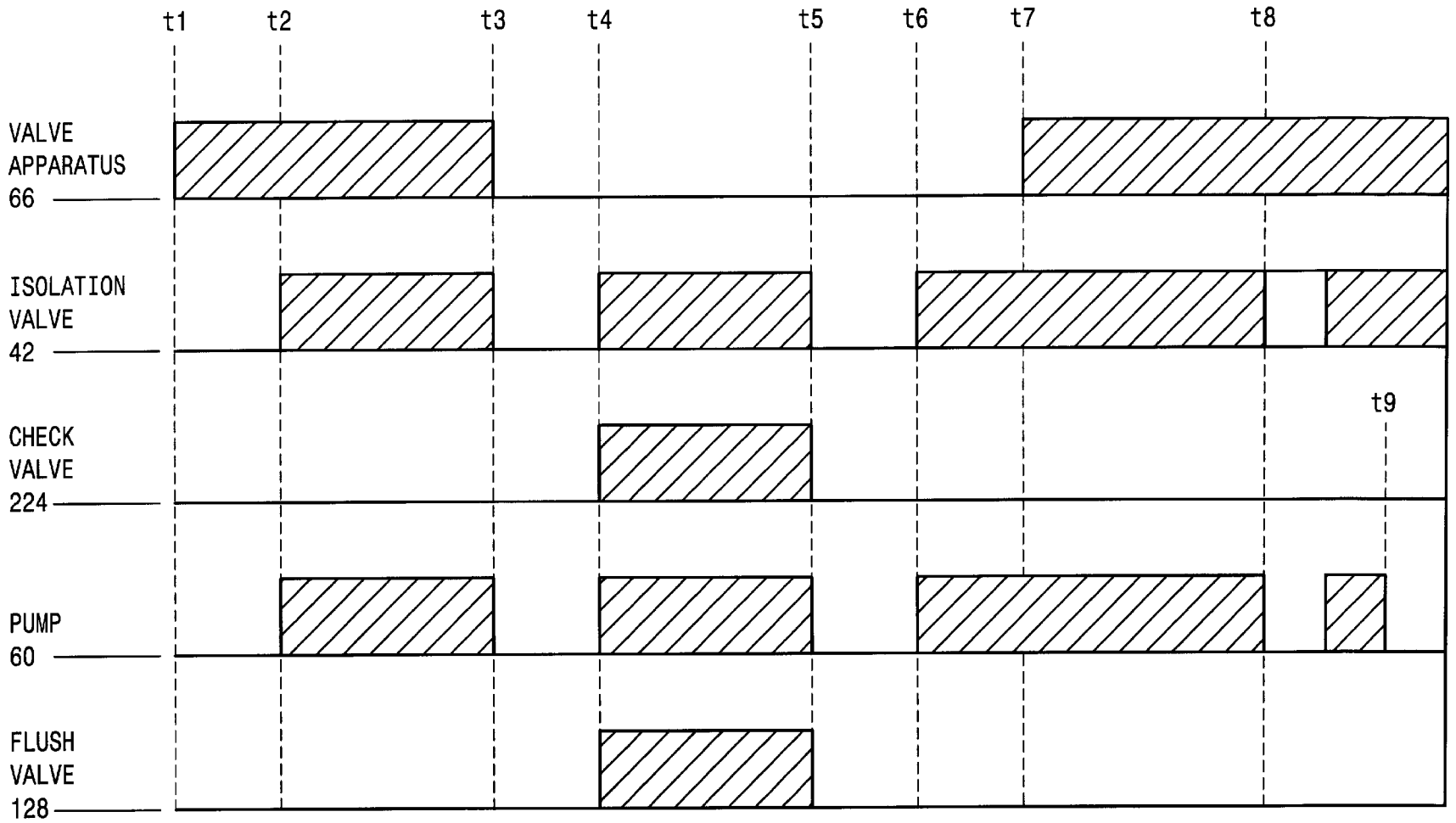
FIG. 4 is a timing chart for the control system of FIG. 3.

As shown schematically in FIG. 4 at time=t8, t9, the pump 60 and the tool isolation valve 42 may be operated independently (manually or automatically) to control the system 10 as desired. In operation, the isolation valve 42 is cycled on and off more frequently than the four-port valve apparatus 66.

The above descriptions and drawings are only illustrative of preferred embodiments which achieve the features and advantages of the present invention, and it is not intended that the present invention be limited thereto. Any modification of the present invention which comes within the spirit and scope of the following claims is considered part of the present invention.

What is claimed as new and desired to be protected by Letters Patent of the United States is:

1. A flush system for use with wafer processing equipment, said system comprising:

a first one-way valve for supplying a flush liquid to a valve apparatus at a first pressure;

a flush liquid source for supplying the flush liquid to said one-way valve at a second pressure greater than the first pressure; and a pressure regulator for maintaining the second pressure, said pressure regulator being in fluid communication with said first one-way valve, wherein said pressure regulator includes a second one-way valve for draining the flush liquid from said flush liquid source.

2. A slurry system, comprising:

a slurry source for supplying a slurry at a first pressure;

a flush liquid source for supplying a flush liquid at a second pressure;

a slurry supply apparatus for supplying the slurry to a tool; and a flush liquid supply apparatus for supplying the flush liquid to said slurry supply apparatus at a third pressure and for preventing the slurry from entering said flush liquid source, the third pressure being less than the first pressure, and the third pressure being less than the second pressure.

3. The system of claim 2, wherein said flush liquid supply apparatus includes a first one-way valve for allowing the flush liquid to flow into said slurry supply apparatus, and wherein said slurry system further comprises an upstream conduit connected to said one-way valve, a downstream conduit connected to said one-way valve, and a second one-way valve for controlling the pressure of the flush liquid within said upstream conduit.

4. The system of claim 3, further comprising a valve apparatus for selectively allowing the slurry to flow from said slurry source and into said slurry supply apparatus and for allowing the flush liquid to flow from said flush liquid supply apparatus and into said slurry supply apparatus, said valve apparatus being located between said first one-way valve and said slurry supply apparatus.

5. The system of claim 4, wherein said flush liquid source includes a shut-off valve in fluid communication with said first and second one-way valves.

6. The system of claim 4, wherein said slurry supply apparatus includes a pump and a shut-off valve, said shut-off valve being located between said pump and said valve apparatus.

7. A wafer processing system, comprising:

a tool for mechanically treating wafer products;

a slurry supply apparatus for supplying a slurry to said tool;

a slurry source for supplying the slurry to said slurry supply apparatus at a first pressure; and a flush apparatus for supplying de-ionized water to said slurry supply apparatus at a second pressure less than the first pressure, wherein said flush apparatus includes a first check valve for allowing the de-ionized water to flow into said slurry supply apparatus, and a second check valve for controlling the pressure of the de-ionized water upstream from said first check valve.

8. The system of claim 7, wherein said tool is a chemical-mechanical planarization apparatus.

9. The system of claim 7, wherein said tool is a wafer polishing apparatus.

10. The system of claim 9, further comprising a peristaltic pump for pumping the slurry.

11. The system of claim 10, further comprising a shut-off valve for preventing the slurry from flowing to said pump.

12. The system of claim 7, wherein the opening force of said second check valve is adjustable.

13. The system of claim 7, further comprising a four-port valve apparatus for selectively allowing the slurry to flow from said slurry source and into said slurry supply apparatus and for allowing the de-ionized water to flow from said flush apparatus and into said slurry supply apparatus.

14. The system of claim 13, further comprising a programmable system for selectively actuating said shut-off valve, said four-port valve apparatus, and said pump.

15. A slurry handling apparatus for use with wafer processing equipment, said apparatus comprising:

a slurry source for supplying slurry, said slurry source including a valve apparatus;

a pump for pumping the slurry;

a flush apparatus for supplying de-ionized water to a tool, wherein said flush apparatus includes a first check valve for allowing the de-ionized water to flow into said slurry supply apparatus, and a second check valve for controlling the pressure of the de-ionized water upstream from said first check valve; and a sequencing control unit for controlling said valve apparatus and said pump.

16. The apparatus of claim 15, wherein said pump is manually operable.

* * * * *

UNITED STATES PATENT AND TRADEMARK OFFICE

CERTIFICATE OF CORRECTION

PATENT NO. : 6,102,782
DATED : August 15, 2000
INVENTOR(S) : Daniel G. Custer et al.

It is certified that error appears in the above-identified patent and that said Letters Patent is hereby corrected as shown below:

Column 8:
Line 19, change "the opening" to --an opening--.

Signed and Sealed this

Twelfth Day of June, 2001

Nicholas P. Godici

*Attest:*

*Attesting Officer*

NICHOLAS P. GODICI
*Acting Director of the United States Patent and Trademark Office*